US011506426B2

(12) United States Patent
Xu

(10) Patent No.: US 11,506,426 B2
(45) Date of Patent: Nov. 22, 2022

(54) PULSE TUBE CRYOCOOLER AND METHOD OF MANUFACTURING PULSE TUBE CRYOCOOLER

(71) Applicant: SUMITOMO HEAVY INDUSTRIES, LTD., Tokyo (JP)

(72) Inventor: Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/192,852

(22) Filed: Mar. 4, 2021

(65) Prior Publication Data

US 2021/0207853 A1 Jul. 8, 2021

Related U.S. Application Data

(63) Continuation of application No. PCT/JP2019/030304, filed on Aug. 1, 2019.

(30) Foreign Application Priority Data

Sep. 20, 2018 (JP) ..... JP2018-175585

(51) Int. Cl.
*F25B 9/14* (2006.01)
*F25B 9/10* (2006.01)

(52) U.S. Cl.
CPC ..... *F25B 9/145* (2013.01); *F25B 9/10* (2013.01); *F25B 2309/1408* (2013.01); *F25B 2309/1412* (2013.01); *F25B 2309/1421* (2013.01)

(58) Field of Classification Search
CPC ..... F25B 9/145; F25B 2309/1412; F25B 2309/1421
See application file for complete search history.

(56) References Cited

U.S. PATENT DOCUMENTS

| | | | | |
|---|---|---|---|---|
| 6,715,300 | B2 * | 4/2004 | Longsworth | F25B 9/145 165/4 |
| 7,600,386 | B2 | 10/2009 | Saito et al. | |
| 9,423,160 | B2 | 8/2016 | Xu | |
| 9,976,780 | B2 * | 5/2018 | Nakano | F25B 9/14 |
| 10,624,238 | B2 | 4/2020 | Shioga et al. | |

(Continued)

FOREIGN PATENT DOCUMENTS

| | | | |
|---|---|---|---|
| JP | H05118685 | A | 5/1993 |
| JP | 2000205674 | A | 7/2000 |
| JP | 2002257428 | A | 9/2002 |

(Continued)

*Primary Examiner* — Lionel Nouketcha
(74) *Attorney, Agent, or Firm* — HEA Law PLLC

(57) ABSTRACT

A pulse tube cryocooler includes a pulse tube that includes a tube inner space, and an integral flow straightener that includes a flow straightening layer disposed to face the tube inner space so as to straighten a refrigerant gas flow from the tube inner space or into the tube inner space and a heat exchange layer formed integrally with the flow straightening layer outside the flow straightening layer with respect to the tube inner space so as to exchange heat with the refrigerant gas flow by contact with the refrigerant gas flow and is disposed at a low-temperature end and/or a high-temperature end of the pulse tube. The flow straightening layer includes a plurality of protrusions that protrude from the heat exchange layer toward the tube inner space.

8 Claims, 6 Drawing Sheets

(56) References Cited

U.S. PATENT DOCUMENTS

| | | | | |
|---|---|---|---|---|
| 2007/0157632 | A1* | 7/2007 | Saito | F25B 9/145 62/6 |
| 2014/0338368 | A1* | 11/2014 | Nakano | F25B 9/145 62/6 |

FOREIGN PATENT DOCUMENTS

| | | | |
|---|---|---|---|
| JP | 2003148826 | A | 5/2003 |
| JP | 2004301445 | A | 10/2004 |
| JP | 2005030704 | A | 2/2005 |
| JP | 2005127633 | A | 5/2005 |
| JP | 2006275429 | A | 10/2006 |
| JP | 2006284060 | A | 10/2006 |
| JP | 2013217516 | A | 10/2013 |
| JP | 2015230131 | A | 12/2015 |
| JP | 2016187912 | A | 11/2016 |
| JP | WO2017203574 | A1 | 11/2017 |

* cited by examiner

PULSE TUBE CRYOCOOLER AND METHOD OF MANUFACTURING PULSE TUBE CRYOCOOLER

RELATED APPLICATIONS

The contents of Japanese Patent Application No. 2018-175585, and of International Patent Application No.PCT/JP2019/030304, on the basis of each of which priority benefits are claimed in an accompanying application data sheet, are in their entirety incorporated herein by reference.

BACKGROUND

Technical Field

Certain embodiments of the present invention relate to a pulse tube cryocooler and a method of manufacturing a pulse tube cryocooler.

Description of Related Art

In the related art, it has been known to provide a flow straightener made of stacked wire nets at a high-temperature end and a low-temperature end of a pulse tube of a pulse tube cryocooler.

SUMMARY

According to an aspect of the present invention, a pulse tube cryocooler includes a pulse tube that includes a tube inner space, and an integral flow straightener that includes a flow straightening layer disposed to face the tube inner space so as to straighten a refrigerant gas flow from the tube inner space or into the tube inner space and a heat exchange layer formed integrally with the flow straightening layer outside the flow straightening layer with respect to the tube inner space so as to exchange heat with the refrigerant gas flow by contact with the refrigerant gas flow and is disposed at a low-temperature end and/or a high-temperature end of the pulse tube. The flow straightening layer includes a plurality of protrusions that protrude from the heat exchange layer toward the tube inner space.

According to another aspect of the present invention, a method of manufacturing a pulse tube cryocooler is provided. This method includes manufacturing an integral flow straightener in which a flow straightening layer and a heat exchange layer are integrally formed by 3D printing, and mounting the integral flow straightener at the low-temperature end and/or the high-temperature end of the pulse tube.

DETAILED DESCRIPTION

Figure 1:
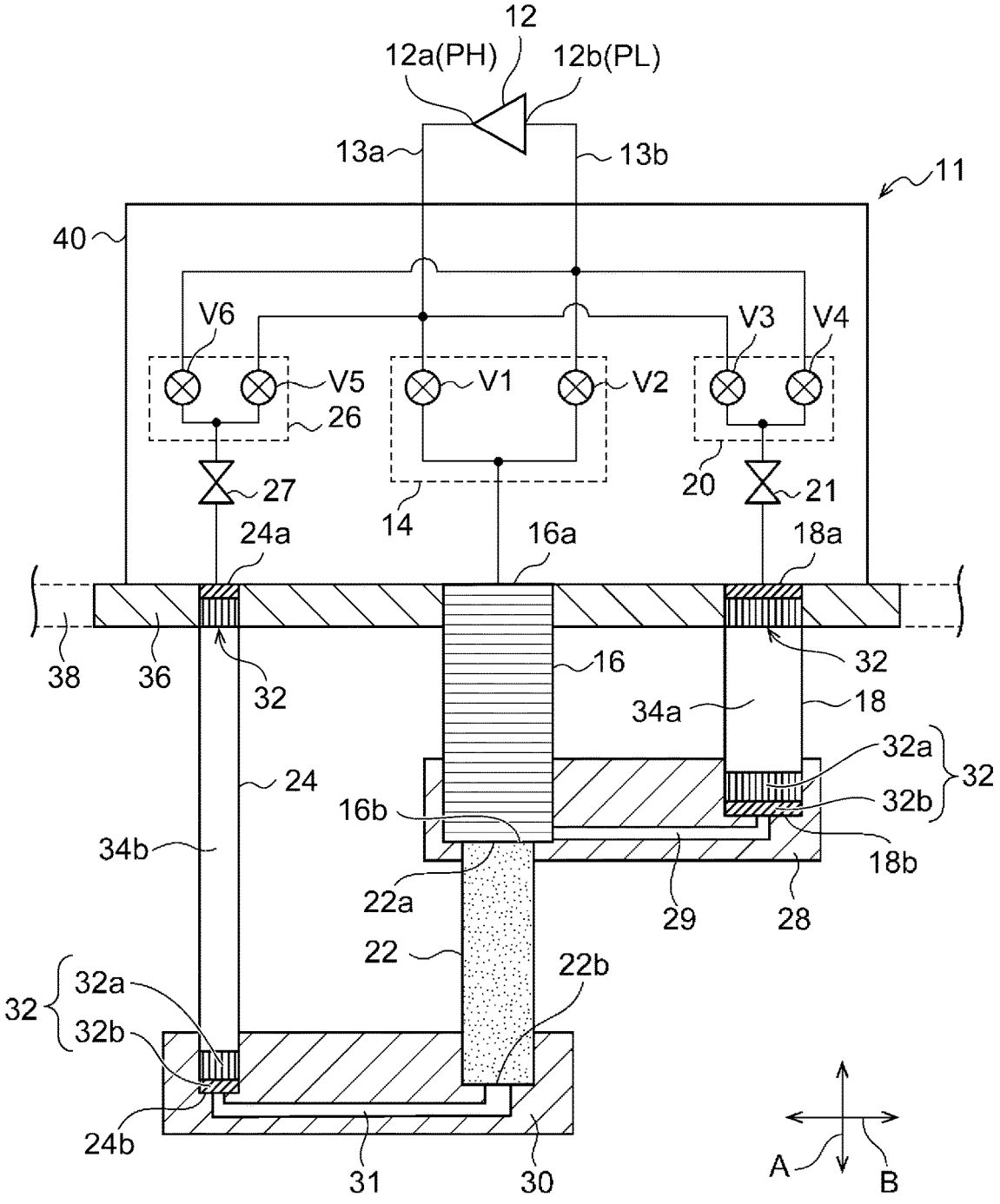
FIG. 1 is a schematic view illustrating a pulse tube cryocooler according to an embodiment.

The present inventor has studied a flow straightener made of stacked wire nets used in the related art in the pulse tube cryocooler and has come to recognize the following problems. When the flow straightener is designed, the specifications (for example, wire diameter, the number of meshes, weaving method, wire, and the like) of each wire net constituting the stacked wire nets are designated. Even in a case where a plurality of wire nets to be stacked have the same specifications, in practice, the positions of the meshes are not strictly aligned for all the wire nets. For that reason, when the wire nets are stacked, the mesh positions of two adjacent wire nets do not coincide with each other, and wires of one wire net may be located directly below the meshes of the other wire net. In this way, in a case where the meshes of the individual wire nets in the stacked wire nets are not aligned with each other, the flow of a refrigerant gas flowing through the stacked wire nets may be disturbed, and the flow straightening effect as the flow straightener may be decreased. Additionally, since a contact thermal resistance is present between two adjacent wire nets, a temperature difference may occur between the wire nets. This can decrease the heat exchange efficiency in the flow straightener.

It is desirable to provide a pulse tube cryocooler having a flow straightener with an improved flow straightening effect and/or heat exchange efficiency.

In addition, optional combinations of the above constituent elements and those obtained by substituting the constituent elements or expressions of the present invention with each other among methods, devices, systems, and the like are also effective as aspects of the present inventions.

According to the present invention, it is possible to provide the pulse tube cryocooler having the flow straightener with an improved flow straightening effect and/or heat exchange efficiency.

Hereinafter, modes for carrying out the present invention will be described in detail, referring to the drawings. In addition, the same elements in the description will be designated by the same reference signs, and the duplicate description thereof will be appropriately omitted. Additionally, the configuration to be described below is merely exemplary and does not limit the scope of the present invention at all. Additionally, in the drawings to be referred to in the following description, the size and thickness of respective constituent members are for convenience of description, and do not necessarily indicate actual dimensions and ratios.

FIG. 1 is a schematic view illustrating a pulse tube cryocooler 10 according to the embodiment. The pulse tube cryocooler 10 includes a cold head 11 and a compressor 12.

The pulse tube cryocooler 10 is a Gifford-McMahon (GM) type four-valve pulse tube type cryocooler as an example. Thus, the pulse tube cryocooler 10 includes a main pressure switching valve 14, a first-stage regenerator 16, a first-stage pulse tube 18, and a first-stage phase control mechanism having a first-stage auxiliary pressure switching valve 20 and optionally a first-stage flow rate adjustment element 21. The compressor 12 and the main pressure switching valve 14 constitute an oscillating flow generation source of the pulse tube cryocooler 10. The compressor 12 is shared by the oscillating flow generation source and the first-stage phase control mechanism.

Additionally, the pulse tube cryocooler 10 is a two-stage cryocooler, and further includes a second-stage regenerator 22, a second-stage pulse tube 24, and a second-stage phase control mechanism having a second-stage auxiliary pressure switching valve 26 and optionally a second-stage flow rate adjustment element 27. The compressor 12 is also shared by the second-stage phase control mechanism.

In the present specification, in order to describe a positional relationship between constituent elements of the pulse tube cryocooler 10, terms "longitudinal direction A" and "lateral direction B" are used for convenience. Typically, the longitudinal direction A and the lateral direction B are respectively an axial direction and a radial direction of the pulse tube (18, 24) and the regenerator (16, 22). However, the longitudinal direction A and the lateral direction B may be directions substantially orthogonal to each other, and do not require "strictly orthogonal". Additionally, the notation of the longitudinal direction A and the lateral direction B does not limit a posture in which the pulse tube cryocooler 10 is installed at a point of use. The pulse tube cryocooler 10 is capable of being installed in a desired posture, for example, may be installed such that the longitudinal direction A and the lateral direction B are respectively directed to a vertical direction and a horizontal direction, or contrarily, may be installed such that the longitudinal direction A and the lateral direction B are respectively directed to the horizontal direction and the vertical direction. Alternatively, the pulse tube cryocooler 10 may be installed such that the longitudinal direction A and the lateral direction B are respectively directed to oblique directions different from each other.

The two regenerators (16, 22) are connected in series, and extend in the longitudinal direction A. The two pulse tubes (18, 24) extend in the longitudinal direction A, respectively. The first-stage regenerator 16 is disposed in parallel with the first-stage pulse tube 18 in the lateral direction B, and the second-stage regenerator 22 is disposed in parallel with the second-stage pulse tube 24 in the lateral direction B. The first-stage pulse tube 18 has almost the same length as the first-stage regenerator 16 in the longitudinal direction A, and the second-stage pulse tube 24 has almost the same length as the total length of the first-stage regenerator 16 and the second-stage regenerator 22 in the longitudinal direction A. The regenerator (16, 22) and the pulse tube (18, 24) are disposed substantially parallel to each other.

The compressor 12 has a compressor discharge port 12*a* and a compressor intake port 12*b*, and is configured so as to compress a recovered working gas of low pressure PL to create a working gas of high pressure PH. The working gas is supplied from the compressor discharge port 12*a* through the first-stage regenerator 16 to the first-stage pulse tube 18, and the working gas is recovered from the first-stage pulse tube 18 through the first-stage regenerator 16 to the compressor intake port 12*b*. Additionally, the working gas is supplied from the compressor discharge port 12*a* through the first-stage regenerator 16 to the second-stage pulse tube 24, and the second-stage regenerator 22, and the working gas is recovered from the second-stage pulse tube 24 through the second-stage regenerator 22 and the first-stage regenerator 16 to the compressor intake port 12*b*.

The compressor discharge port 12*a* and the compressor intake port 12*b* respectively function as a high-pressure source and a low-pressure source of the pulse tube cryocooler 10. The working gas is also referred to as refrigerant gas, and is, for example, helium gas. In addition, generally, both high pressure PH and low pressure PL are significantly higher than atmospheric pressure.

The main pressure switching valve 14 has a main intake opening/closing valve V1 and a main exhaust opening/closing valve V2. The first-stage auxiliary pressure switching valve 20 has a first-stage auxiliary intake opening/closing valve V3 and a first-stage auxiliary exhaust opening/closing valve V4. The second-stage auxiliary pressure switching valve 26 has a second-stage auxiliary intake opening/closing valve V5 and a second-stage auxiliary exhaust opening/closing valve V6.

The pulse tube cryocooler 10 is provided with a high pressure line 13*a* and a low pressure line 13*b*. The working gas of the high pressure PH flows from the compressor 12 through the high pressure line 13*a* into the cold head 11. The working gas of the low pressure PL flows from the cold head 11 through the low pressure line 13*b* into the compressor 12. The high pressure line 13*a* connects the compressor discharge port 12*a* to the intake opening/closing valves (V1, V3, and V5). The low pressure line 13*b* connects the compressor intake port 12*b* to the exhaust opening/closing valves (V2, V4, and V6).

The first-stage regenerator 16 has a first-stage regenerator high-temperature end 16*a* and a first-stage regenerator low-temperature end 16*b*, and extends in the longitudinal direction A from the first-stage regenerator high-temperature end 16*a* to the first-stage regenerator low-temperature end 16*b*. The first-stage regenerator high-temperature end 16*a* and the first-stage regenerator low-temperature end 16*b* may be respectively referred to as a first end and a second end of the first-stage regenerator 16. Similarly, the second-stage regenerator 22 has a second-stage regenerator high-temperature end 22*a* and a second-stage regenerator low-temperature end 22*b*, and extends in the longitudinal direction A from the second-stage regenerator high-temperature end 22*a* to the second-stage regenerator low-temperature end 22*b*. The second-stage regenerator high-temperature end 22*a* and the second-stage regenerator low-temperature end 22*b* may be respectively referred to as a first end and a second end of the second-stage regenerator 22. The first-stage regenerator low-temperature end 16*b* communicates with the second-stage regenerator high-temperature end 22*a*.

The first-stage pulse tube 18 has a first-stage pulse tube high-temperature end 18*a* and a first-stage pulse tube low-temperature end 18*b*, and extends in the longitudinal direction A from the first-stage pulse tube high-temperature end 18*a* to the first-stage pulse tube low-temperature end 18*b*. The first-stage pulse tube high-temperature end 18*a* and the first-stage pulse tube low-temperature end 18*b* may be respectively referred to as a first end and a second end of the first-stage pulse tube 18.

The first-stage pulse tube 18 has a first-stage tube inner space 34*a* therein. The refrigerant gas can flow from the first-stage pulse tube high-temperature end 18*a* to the first-stage pulse tube low-temperature end 18*b* (or from the first-stage pulse tube low-temperature end 18*b* to the first-stage pulse tube high-temperature end 18*a*) through the first-stage tube inner space 34*a*.

Similarly, the second-stage pulse tube 24 has a second-stage pulse tube high-temperature end 24*a* and a second-stage pulse tube low-temperature end 24*b*, and extends in the longitudinal direction A from the second-stage pulse tube high-temperature end 24*a* to the second-stage pulse tube low-temperature end 24*b*. The second-stage pulse tube high-temperature end 24*a* and the second-stage pulse tube low-temperature end 24*b* maybe respectively referred to as a first end and a second end of the second-stage pulse tube 24.

The second-stage pulse tube 24 has a second-stage tube inner space 34*b* therein. The refrigerant gas can flow from the second-stage pulse tube high-temperature end 24*a* to the second-stage pulse tube low-temperature end 24*b* (or from the second-stage pulse tube low-temperature end 24*b* to the second-stage pulse tube high-temperature end 24*a*) through the second-stage tube inner space 34*b*. Hereinafter, the first-stage tube inner space 34*a* and the second-stage tube inner space 34*b* may be collectively referred to as a tube inner space 34.

Each of both ends of the pulse tube (18, 24) is provided with an integral flow straightener 32 for equalizing the working gas flow velocity distribution within a plane perpendicular to the axial direction of the pulse tube or performing adjustment to a desired distribution. The integral flow straightener 32 also functions as a heat exchanger. The integral flow straightener 32 includes a flow straightening layer 32*a* and a heat exchange layer 32*b* integrally formed with the flow straightening layer 32*a*. The flow straightening layer 32*a* is disposed to face the tube inner space 34 so as to straighten the refrigerant gas flow from the tube inner space 34 or to the tube inner space 34. The heat exchange layer 32*b* is disposed outside the flow straightening layer 32*a* with respect to the tube inner space 34 so as to exchange heat with the refrigerant gas flow by contact with the refrigerant gas flow. Details of the integral flow straightener 32 will be described below.

In an exemplary configuration, the regenerator (16, 22) is a cylindrical tube the interior of which is filled with a regenerator material, and the pulse tube (18, 24) is a cylindrical tube the interior of which is a cavity. Thus, the first-stage tube inner space 34*a* and the second-stage tube inner space 34*b* are columnar spaces, respectively. The integral flow straightener 32 has a disc (or short columnar) shape as a whole.

The cold head 11 includes a first-stage cooling stage 28 and a second-stage cooling stage 30.

The first-stage regenerator 16 and the first-stage pulse tube 18 extend in the same direction from the first-stage cooling stage 28, and the first-stage regenerator high-temperature end 16*a* and the first-stage pulse tube high-temperature end 18*a* are disposed on the same side with respect to the first-stage cooling stage 28. In this way, the first-stage regenerator 16, the first-stage pulse tube 18, and the first-stage cooling stage 28 are disposed in a U shape. Similarly, the second-stage regenerator 22 and the second-stage pulse tube 24 extend in the same direction from the second-stage cooling stage 30, and the second-stage regenerator high-temperature end 22*a* and the second-stage pulse tube high-temperature end 24*a* are disposed on the same side with respect to the second-stage cooling stage 30. In this way, the second-stage regenerator 22, the second-stage pulse tube 24, and the second-stage cooling stage 30 are disposed in a U shape.

The first-stage pulse tube low-temperature end 18*b* and the first-stage regenerator low-temperature end 16*b* are structurally connected to each other and thermally coupled to each other by the first-stage cooling stage 28. A first-stage communication passage 29, which allows the first-stage regenerator low-temperature end 16*b* to communicate with the first-stage pulse tube low-temperature end 18*b* is formed inside the first-stage cooling stage 28. Similarly, the second-stage pulse tube low-temperature end 24*b* and the second-stage regenerator low-temperature end 22*b* are structurally connected to each other and thermally coupled to each other by the second-stage cooling stage 30. A second-stage communication passage 31, which allows the second-stage regenerator low-temperature end 22*b* to communicate with the second-stage pulse tube low-temperature end 24*b* is formed inside the second-stage cooling stage 30.

The integral flow straightener 32 is attached to a high-temperature end and/or a low-temperature end of a pulse tube by joining the heat exchange layer 32*b* to the pulse tube. The flow straightening layer 32*a* is supported by the heat exchange layer 32*b*. In addition, the flow straightening layer 32*a* may be joined to the pulse tube together with the heat exchange layer 32*b* or instead of the heat exchange layer 32*b*.

For example, the integral flow straightener 32 disposed at the first-stage pulse tube low-temperature end 18*b* has the heat exchange layer 32*b* joined to the first-stage pulse tube low-temperature end 18*b*, and thereby, the integral flow straightener 32 is structurally connected to and thermally coupled to the first-stage pulse tube low-temperature end 18*b* and the first-stage cooling stage 28. The heat exchange layer 32*b* may be joined to the first-stage cooling stage 28. Similarly, the integral flow straightener 32 disposed at the second-stage pulse tube low-temperature end 24*b* has the heat exchange layer 32*b* joined to the second-stage pulse tube low-temperature end 24*b*, and thereby, the integral flow straightener 32 is structurally connected to and thermally coupled to the second-stage pulse tube low-temperature end 24*b* and the second-stage cooling stage 30. The heat exchange layer 32*b* may be joined to the second-stage cooling stage 30.

Therefore, the refrigerant gas supplied from the compressor 12 can pass through the first-stage communication passage 29 from the first-stage regenerator low-temperature end 16*b*, and further pass through the integral flow straightener 32 of the first-stage pulse tube low-temperature end 18*b* and flow to the first-stage tube inner space 34*a*. The return gas from the first-stage pulse tube 18 can flow from the first-stage tube inner space 34*a* through the integral flow straightener 32 of the first-stage pulse tube low-temperature end 18*b* and the first-stage communication passage 29 to the first-stage regenerator low-temperature end 16*b*.

Also in the second stage, the refrigerant gas supplied from the compressor 12 can pass through the second-stage communication passage 31 from the second-stage regenerator low-temperature end 22*b*, and further pass through the integral flow straightener 32 of the second-stage pulse tube low-temperature end 24*b* and flow to the second-stage tube inner space 34*b*. The return gas from the second-stage pulse tube 24 can flow from the second-stage tube inner space 34*b* through the integral flow straightener 32 of the second-stage pulse tube low-temperature end 24*b* and the second-stage communication passage 31 to the second-stage regenerator low-temperature end 22*b*.

The cooling stage (28, 30) and the integral flow straightener 32 are formed of, for example, a metallic material, such as copper, which has high thermal conductivity. However, the cooling stage (28, 30) and the integral flow straightener 32 are not essentially formed of the same material, and may be formed of different materials.

An object (not illustrated) to be cooled is thermally coupled to the second-stage cooling stage 30. The object may be directly installed on the second-stage cooling stage 30, or may be thermally coupled to the second-stage cooling stage 30 via a rigid or flexible heat transfer member. The pulse tube cryocooler 10 can cool the object by the conduction cooling from the second-stage cooling stage 30. In addition, the object to be cooled by the pulse tube cryocooler 10 may be superconducting electromagnets or other superconducting devices, or infrared imaging devices or other sensors, as examples without limitation. The pulse tube cryocooler 10 can also cool the gas or liquid contacting the second-stage cooling stage 30.

Additionally, needless to say, an object different from the object to be cooled by the second-stage cooling stage 30 may be cooled by the first-stage cooling stage 28. For example, a radiation shield for reducing or preventing entering of heat into the second-stage cooling stage 30 maybe thermally coupled to the first-stage cooling stage 28.

Meanwhile, the first-stage regenerator high-temperature end 16*a*, the first-stage pulse tube high-temperature end 18*a*, and the second-stage pulse tube high-temperature end 24*a* are connected to each other by a flange part 36. The flange part 36 is attached to a supporting part 38, such as a supporting base or a supporting wall, in which the pulse tube cryocooler 10 is installed. The supporting part 38 may be a wall member or other parts of a heat-insulating container or a vacuum vessel that houses the cooling stage (28, 30) and the object to be cooled.

The pulse tube (18, 24) and the regenerator (16, 22) extend from one main surface of the flange part 36 to the cooling stage (28, 30), and a valve part 40 is provided on the other main surface of the flange part 36. The main pressure switching valve 14, the first-stage auxiliary pressure switching valve 20, and the second-stage auxiliary pressure switching valve 26 are housed in the valve part 40. Hence, in a case where the supporting part 38 constitutes a portion of the heat-insulating container or the vacuum vessel, when the flange part 36 is attached to the supporting part 38, the pulse tubes (18, 24), the regenerators (16, 22), and the cooling stages (28, 30) are housed within the container, and the valve part 40 is disposed out of the container.

In addition, it is not necessary that the valve part 40 is directly attached to the flange part 36. The valve part 40 may be disposed separately from the cold head 11 of the pulse tube cryocooler 10, and may be connected to the cold head 11 by a rigid or flexible pipe. In this way, the phase control mechanism of the pulse tube cryocooler 10 may be disposed separately from the cold head 11.

The main pressure switching valve 14 is configured such that the first-stage regenerator high-temperature end 16*a* is alternately connected to the compressor discharge port 12*a* and the compressor intake port 12*b* in order to create pressure oscillation within the pulse tube (18, 24). The main pressure switching valve 14 is configured such that one of the main intake opening/closing valve V1 and the main exhaust opening/closing valve V2 is open and the other thereof is closed. The main intake opening/closing valve V1 connects the compressor discharge port 12*a* to the first-stage regenerator high-temperature end 16*a*, and the main exhaust opening/closing valve V2 connects the compressor intake port 12*b* to the first-stage regenerator high-temperature end 16*a*.

When the main intake opening/closing valve V1 is open, the working gas is supplied from the compressor discharge port 12*a* through the high pressure line 13*a* and the main intake opening/closing valve V1 to the regenerators (16, 22). The working gas is further supplied from the first-stage regenerator 16 through the first-stage communication passage 29 and the integral flow straightener 32 to the first-stage pulse tube 18, and is supplied from the second-stage regenerator 22 through the second-stage communication passage 31 and the integral flow straightener 32 to the second-stage pulse tube 24. Meanwhile, when the main exhaust opening/closing valve V2 is open, the working gas is recovered from the pulse tube (18, 24) through the regenerator (16, 22), the main exhaust opening/closing valve V2, and the low pressure line 13*b* to the compressor intake port 12*b*.

The first-stage auxiliary pressure switching valve 20 is configured such that the first-stage pulse tube high-temperature end 18*a* is alternately connected to the compressor discharge port 12*a* and the compressor intake port 12*b*. The first-stage auxiliary pressure switching valve 20 is configured such that one of the first-stage auxiliary intake opening/closing valve V3 and the first-stage auxiliary exhaust opening/closing valve V4 is open and the other thereof is closed. The first-stage auxiliary intake opening/closing valve V3 connects the compressor discharge port 12*a* to the first-stage pulse tube high-temperature end 18*a*, and the first-stage auxiliary exhaust opening/closing valve V4 connects the compressor intake port 12*b* to the first-stage pulse tube high-temperature end 18*a*.

When the first-stage auxiliary intake opening/closing valve V3 is open, the working gas is supplied from the compressor discharge port 12*a* through the high pressure line 13*a*, the first-stage auxiliary intake opening/closing valve V3, and the first-stage pulse tube high-temperature end 18*a* to the first-stage pulse tube 18. On the other hand, when the first-stage auxiliary exhaust opening/closing valve V4 is open, the working gas is recovered from the first-stage pulse tube 18 through the first-stage pulse tube high-temperature end 18*a*, the first-stage auxiliary exhaust opening/closing valve V4, and the low pressure line 13*b* to the compressor intake port 12*b*.

The second-stage auxiliary pressure switching valve 26 is configured such that the second-stage pulse tube high-temperature end 24*a* is alternately connected to the compressor discharge port 12*a* and the compressor intake port 12*b*. The second-stage auxiliary pressure switching valve 26 is configured such that one of the second-stage auxiliary intake opening/closing valve V5 and the second-stage auxiliary exhaust opening/closing valve V6 is open and the other thereof is closed. The second-stage auxiliary intake opening/closing valve V5 connects the compressor discharge port 12*a* to the second-stage pulse tube high-temperature end 24*a*, and the second-stage auxiliary exhaust opening/closing valve V6 connects the compressor intake port 12*b* to the second-stage pulse tube high-temperature end 24*a*.

When the second-stage auxiliary intake opening/closing valve V5 is open, the working gas is supplied from the compressor discharge port 12*a* through the high pressure line 13*a*, the second-stage auxiliary intake opening/closing valve V5, and the second-stage pulse tube high-temperature end 24*a* to the second-stage pulse tube 24. On the other hand, when the second-stage auxiliary exhaust opening/closing valve V6 is open, the working gas is recovered from the second-stage pulse tube 24 through the second-stage pulse tube high-temperature end 24*a*, the second-stage auxiliary exhaust opening/closing valve V6, and the low pressure line 13*b* to the compressor intake port 12*b*.

As valve timings of the valves (V1 to V6), it is possible to adopt various valve timings that are applicable to existing four-valve type pulse tube cryocoolers.

There may be various specific configurations of the valves (V1 to V6). For example, a group of valves (V1 to V6) may take the form of, for example, a plurality of individually controllable valves, such as electromagnetic opening/closing valves. The valves (V1 to V6) maybe constituted as rotary valves.

By virtue of such a configuration, the pulse tube cryocooler 10 creates pressure oscillations of the working gases of the high pressure PH and the low pressure PL within the pulse tube (18, 24). Displacement oscillation of the working gas, that is, reciprocation of a gas piston, occurs within the pulse tube (18, 24) in synchronization with suitable phase lags of the pressure oscillations. The movement of the working gas that periodically reciprocates up and down within the pulse tube (18, 24) while maintaining a certain pressure is often referred to as the "gas piston", and is used well in order to describe the operation of the pulse tube cryocooler 10. When the gas piston is at or near the pulse tube high-temperature end (18*a*, 24*a*), the working gas expands in the pulse tube low-temperature end (18*b*, 24*b*), and coldness occurs. By repeating such a refrigeration cycle, the pulse tube cryocooler 10 can cool the cooling stage (28, 30). Therefore, the pulse tube cryocooler 10 can cool, for example, various objects to be cooled, such as superconducting electromagnets, to a desired cryogenic temperature.

Figure 2A:
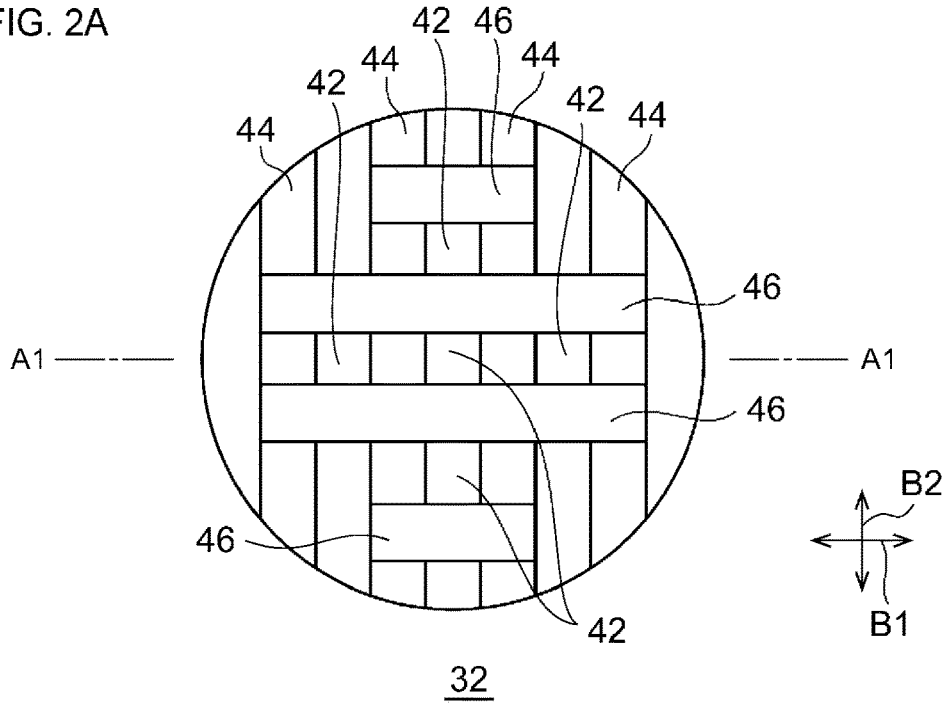
FIGS. 2A to 2C are schematic views illustrating an example of an integral flow straightener that can be used in the pulse tube cryocooler illustrated in FIG. 1.
Figure 2B:
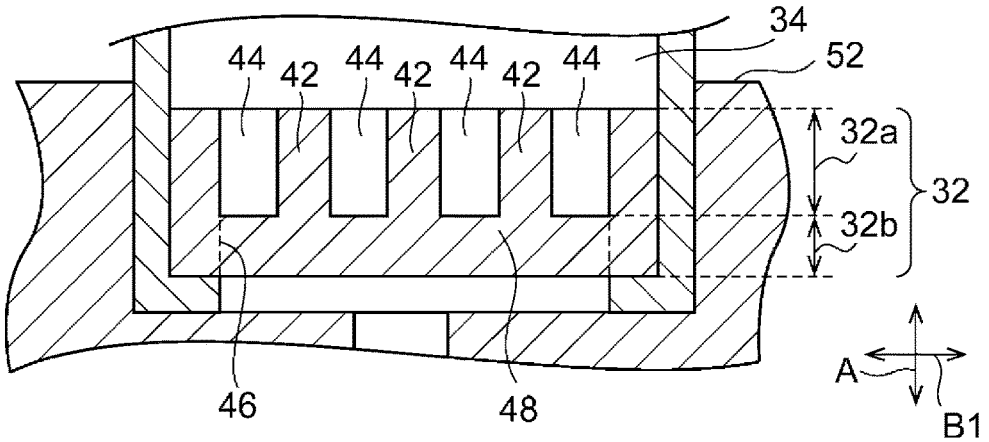
Figure 2C:
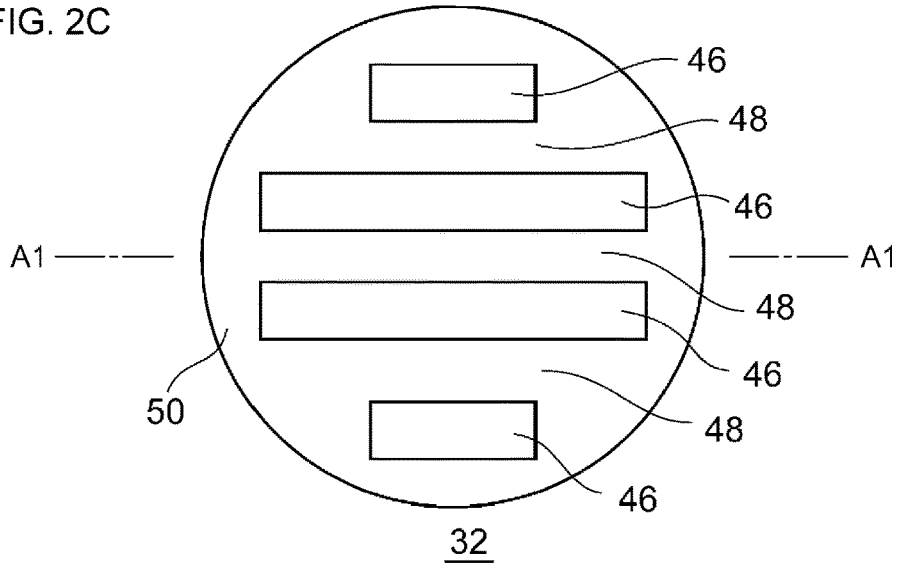

FIGS. 2A to 2C are schematic views illustrating an example of the integral flow straightener 32 that can be used in the pulse tube cryocooler 10 illustrated in FIG. 1. FIG. 2A is a schematic top view of the integral flow straightener 32, FIG. 2B is a schematic sectional view taken along the line A1-A1, and FIG. 2C is a schematic bottom view of the integral flow straightener 32. In order to facilitate understanding, FIG. 2B illustrates a portion of a cooling stage and a portion of a pulse tube, to which the integral flow straightener 32 is attached, together.

For convenience to describe the shape of the integral flow straightener 32, terms of the extending direction of the pulse tube, a first in-plane direction B1, and a second in-plane direction B2 are used in the present specification document. Since the pulse tube extends along the longitudinal direction A illustrated in FIG. 1 as described above, the extending direction of the pulse tube corresponds to the longitudinal direction A illustrated in FIG. 1. The first in-plane direction B1 and the second in-plane direction B2 refer to two directions orthogonal to each other in a plane orthogonal to the extending direction of the pulse tube. The first in-plane direction B1 (or the second in-plane direction B2) may be the same as or different from the lateral direction B illustrated in FIG. 1.

The flow straightening layer 32*a* includes a plurality of protrusions 42 that protrude from the heat exchange layer 32*b* toward the tube inner space 34. A refrigerant gas flow path 44 for straightening flow is formed between the protrusions 42. In order to facilitate understanding, FIGS. 2A to 2C illustrate only a small number of protrusions 42. However, in practice, the flow straightening layer 32*a* may be, for example, hundreds to thousands of protrusions 42 or a larger number of protrusions 42.

The heat exchange layer 32*b* includes a plurality of heat exchange slits 46 and a plurality of heat exchange walls 48. Similar to the protrusions 42, in practice, more slits and walls than illustrated are also provided regarding the heat exchange slits 46 and the heat exchange walls 48. Since the contact area of such a slit type gas flow path with the refrigerant gas is relatively large, the heat exchange efficiency is improved.

The heat exchange slits 46 are formed in the integral flow straightener 32 as heat exchange flow paths between the refrigerant gas and the heat exchange layer 32*b*. Each of the heat exchange slits 46 penetrates the heat exchange layer 32*b* in the longitudinal direction A and extends parallel to the first in-plane direction B1. Each of the heat exchange walls 48 extends parallel to the first in-plane direction B1. The plurality of heat exchange walls 48 are disposed in the second in-plane direction B2 alternately with the plurality of heat exchange slits 46 so as to define one heat exchange slit 46 between two adjacent heat exchange walls 48. The plurality of heat exchange walls 48 are connected to each other by an outer peripheral frame 50 of the heat exchange layer 32*b*. The outer peripheral frame 50 is joined to the pulse tube and/or the cooling stage by an appropriate joining technique such as brazing or welding.

The plurality of protrusions 42 protrude from each of the plurality of heat exchange walls 48 toward the tube inner space 34 and are lined up in the first in-plane direction B1 on the respective heat exchange walls 48. The protrusions 42 are arranged in a grid pattern. The protrusions 42 are disposed at regular intervals in both the first in-plane direction B1 and the second in-plane direction B2. The lengths of the protrusions 42 in the longitudinal direction A are equal to each other.

The refrigerant gas flow path 44 is a groove or recessed part orthogonal to the heat exchange slit 46. The refrigerant gas flow path 44 extends in the second in-plane direction B2. Thus, refrigerant gas flow paths 44 are present on both sides of each protrusion 42 in the first in-plane direction B1, and heat exchange slits 46 are present on both sides of each protrusion 42 in the first in-plane direction B1. In this way, the flow straightening layer 32*a* has a mesh-like flow path facing the tube inner space 34.

The tube inner space 34 communicates with the refrigerant gas flow path 44 between the protrusions 42, and the refrigerant gas flow path 44 communicates with the heat exchange slit 46. The heat exchange slit 46 communicates with the first-stage communication passage 29 (or maybe the second-stage communication passage 31) illustrated in FIG. 1. In this way, the tube inner space 34 communicates with the communication passage inside the cooling stage through the integral flow straightener 32.

Therefore, the integral flow straightener 32 helps settle a trouble that may occur in the related-art flow straightener made of stacked wire nets. As described above, in the stacked wire nets, the mesh positions of two adjacent wire nets do not coincide with each other. Accordingly, the flow of the refrigerant gas may be disturbed while passing through the stacked wire nets, and the flow straightening effect as the flow straightener may be decreased. In contrast, in the integral flow straightener 32, the mesh-like flow path facing the tube inner space 34 is formed linearly in the longitudinal direction A (that is, the depth direction of the flow path). Thus, the occurrence of turbulence in the refrigerant gas flow path 44 is suppressed. Thus, the integral flow straightener 32 can improve the flow straightening effect. Additionally, in the stacked wire nets, the contact thermal resistance between the wire nets may cause a temperature difference inside the stacked wire nets, and thereby the heat exchange efficiency may be decreased. In contrast, in the integral flow straightener 32, the flow straightening layer 32*a* and the heat exchange layer 32*b* are integrally formed. Thus, the temperature difference inside the integral flow straightener 32 is reduced. Thus, the integral flow straightener 32 can improve the heat exchange efficiency.

The flow straightening layer 32*a* includes the plurality of protrusions 42. Accordingly, the mesh-like flow path facing the tube inner space 34 is formed between the protrusions 42. Such a configuration facilitates the manufacture of the refrigerant gas flow path 44 designed to provide better flow straightening effect and/or heat exchange efficiency as compared to the stacked wire nets.

The plurality of protrusions 42 stand upright in parallel with the longitudinal direction A from the heat exchange layer 32*b* toward the tube inner space 34. By doing so, since the direction of the refrigerant gas flow in the tube inner space 34 and each protrusion 42 are disposed parallel to each other, the flow straightening effect of the flow straightening layer 32*a* can be improved.

The length of the plurality of protrusions 42 in the longitudinal direction A is larger than the thickness of the heat exchange layer 32*b* in the longitudinal direction A. By doing so, since the flow straightening layer 32*a* becomes relatively thick, the flow straightening effect of the flow straightening layer 32*a* can be improved. The longitudinal length of the protrusions 42 may be, for example, larger than twice, larger than 5 times, or larger than 10 times the thickness of the heat exchange layer 32*b*. The longitudinal length of the protrusions 42 may be set so as not to exceed an upper surface 52 of the cooling stage when the integral flow straightener 32 is mounted on the cooling stage.

According to the pulse tube cryocooler 10 according to the embodiment, the flow straightening effect and the heat exchange efficiency of the refrigerant gas are enhanced by including the above-described integral flow straightener 32. Accordingly, it is expected that the cryocooling performance of the pulse tube cryocooler 10 will be improved.

Figure 3:
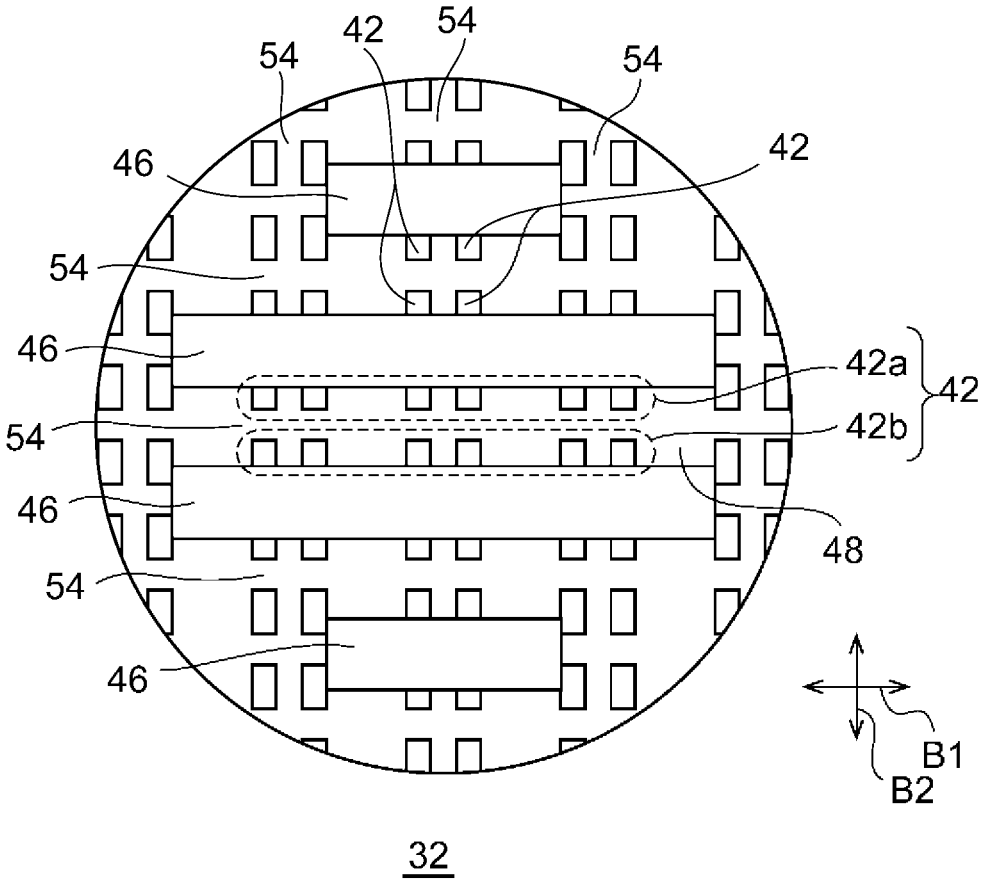
FIG. 3 is a schematic view illustrating another example of the integral flow straightener that can be used in the pulse tube cryocooler illustrated in FIG. 1.

FIG. 3 is a schematic view illustrating another example of the integral flow straightener 32 that can be used in the pulse tube cryocooler 10 illustrated in FIG. 1. FIG. 3 illustrates a schematic top view of the integral flow straightener 32.

The plurality of protrusions 42 are lined up in the first in-plane direction B1 in at least two rows on each heat exchange wall 48. The integral flow straightener 32 has a protrusion separation groove 54 that extends in the first in-plane direction B1, and thereby, a first protrusion row 42*a* and a second protrusion row 42*b* are formed on the heat exchange wall 48. The protrusion separation groove 54 does not penetrate the integral flow straightener 32. One heat exchange slit 46 and a plurality of protrusion rows 42*a* and 42*b* are alternately disposed in the second in-plane direction B2. Additionally, the integral flow straightener 32 also has a protrusion separation groove 54 in the second in-plane direction B2. By making the protrusions 42 thin and disposing the protrusions 42 at a high density in this way, the flow straightening effect of the integral flow straightener 32 is improved.

Figure 4:
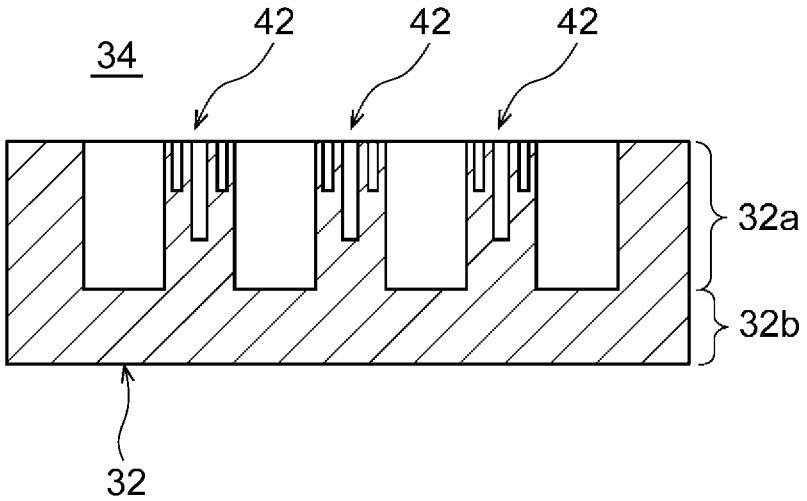
FIG. 4 is a schematic view illustrating another example of the integral flow straightener that can be used in the pulse tube cryocooler illustrated in FIG. 1.

FIG. 4 is a schematic view illustrating still another example of the integral flow straightener 32 that can be used in the pulse tube cryocooler 10 illustrated in FIG. 1. FIG. 4 illustrates a schematic sectional view of the integral flow straightener 32. At least one of the plurality of protrusions 42 branches on the way. The protrusions 42 gradually branch, become thinner, and increase in number from the heat exchange layer 32*b* toward the tube inner space 34. Even in this way, the flow straightening effect of the flow straightening layer 32*a* is improved.

Figure 5A:
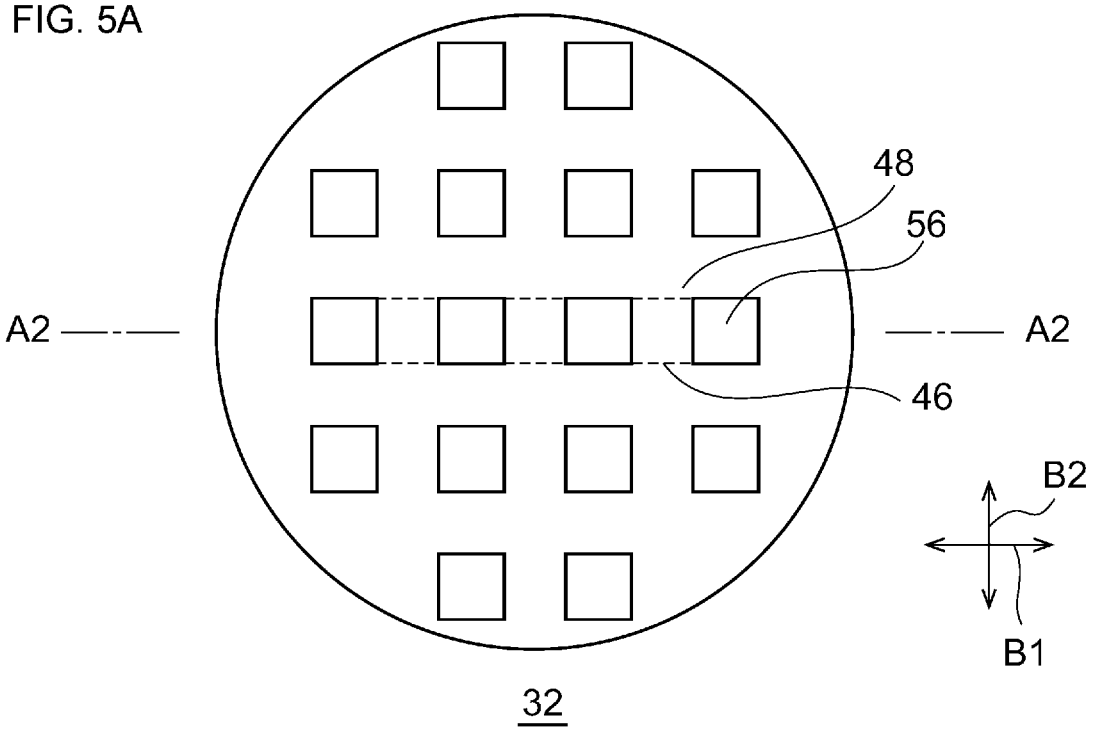
FIGS. 5A and 5B are schematic views illustrating still another example of the integral flow straightener that can be used in the pulse tube cryocooler illustrated in FIG. 1.
Figure 5B:
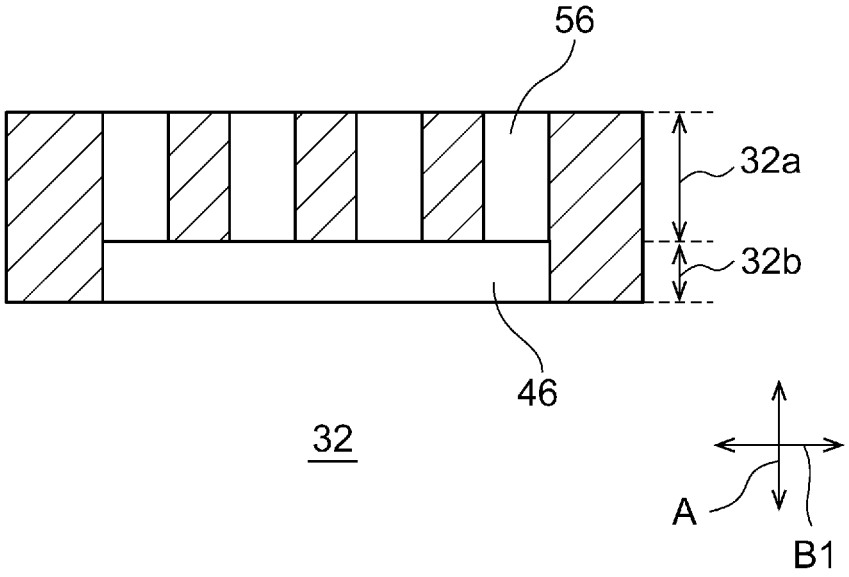

FIGS. 5A and 5B are schematic views illustrating still another example of the integral flow straightener 32 that can be used in the pulse tube cryocooler 10 illustrated in FIG. 1. FIG. 5A is a schematic top view of the integral flow straightener 32, and FIG. 5B is a schematic sectional view taken along line A2-A2.

As illustrated, the flow straightening layer 32*a* may be a porous plate. The flow straightening layer 32*a* has a large number of through-holes 56 instead of the protrusions. As described above, the heat exchange layer 32*b* has the plurality of heat exchange slits 46 and heat exchange walls 48 that are alternately disposed. A plurality of through-holes 56 are lined up along each heat exchange slit 46. A tube inner space of the pulse tube communicates with the through-holes 56, and the through-holes 56 communicates with the heat exchange slits 46. Even in this way, it is possible to provide the integral flow straightener 32 having an improved flow straightening effect and/or heat exchange efficiency as compared to the stacked wire nets.

Figure 6:
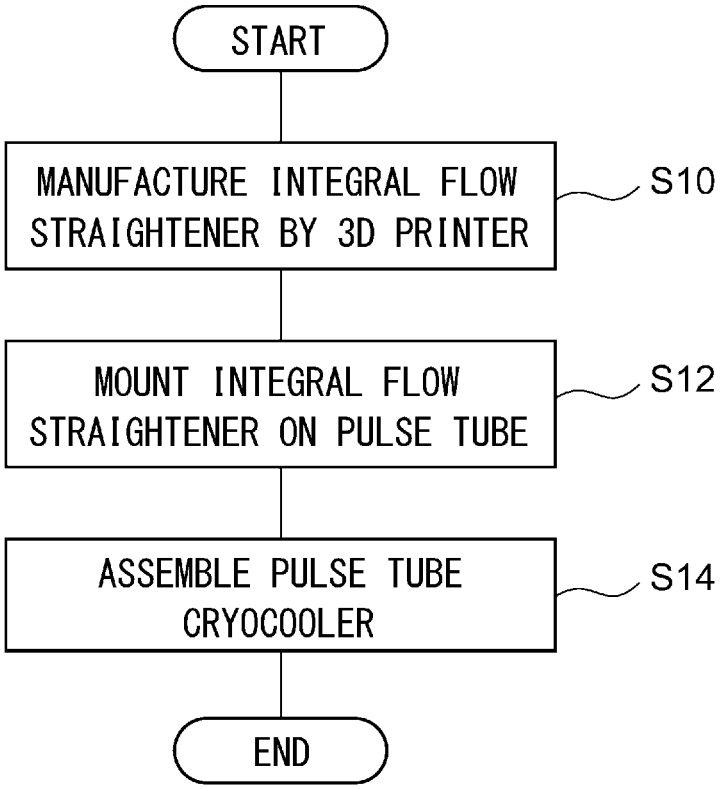
FIG. 6 is a flowchart illustrating a method of manufacturing the pulse tube cryocooler according to the embodiment.

FIG. 6 is a flowchart illustrating a method of manufacturing the pulse tube cryocooler 10 according to the embodiment. First, the integral flow straightener 32 in which the flow straightening layer 32*a* and the heat exchange layer 32*b* are integrally formed is manufactured by 3D printing (S10). Metal 3D printers have been developed that can use high thermal conductive metal materials such as copper (for example, pure copper), which are suitable materials for the integral flow straightener 32 built into the pulse tube cryocooler 10, and such metal 3D printers are generally available.

Next, an integral flow straightener is mounted at the low-temperature end and/or high-temperature end of the pulse tube (S12). As described above, for example, the integral flow straightener 32 is attached to the low-temperature end and high-temperature end of the pulse tube using an appropriate joining technique such as brazing.

Moreover, subsequently, the pulse tube cryocooler 10 is assembled (S14). In addition to the pulse tube to which the integral flow straightener 32 is attached, various constituent elements of the pulse tube cryocooler 10 such as a regenerator and a valve unit are prepared, and the pulse tube cryocooler 10 is finally assembled using these constituent elements. In this way, it is possible to provide the pulse tube cryocooler 10 having the integral flow straightener 32.

According to the present method, the integral flow straightener 32 is manufactured by the 3D printing. The 3D printing has a high degree of freedom in shape design. For that reason, the integral flow straightener 32 designed to realize an excellent flow straightening effect and/or heat exchange efficiency can be manufactured with little or no restrictions due to a manufacturing step. The integral flow straightener 32 is not limited to the above-described specific examples and may have a flow path having an optional shape. The integral flow straightener 32 having a desired three-dimensional shape can be provided.

According to the present method, the integral flow straightener 32 having the plurality of protrusions 42 on the flow straightening layer 32*a*, for example, the integral flow straightener 32 illustrated in FIGS. 2A to 2C, and the integral flow straightener 32 illustrated in FIG. 3, and the integral flow straightener 32 illustrated in FIG. 4 can be manufactured by the 3D printing. The integral flow straightener 32 manufactured by the 3D printing is not limited to these specific examples. For example, the shape and disposition of the protrusions 42 and the heat exchange slits 46 may be optional.

Additionally, according to the present method, the integral flow straightener 32 having the plurality of through-holes 56 in the flow straightening layer 32*a*, for example, the integral flow straightener 32 illustrated in FIGS. 5A and 5B can be manufactured by the 3D printing. Even in this case, the shape and disposition of the through-holes 56 and the heat exchange slits 46 may be optional.

Figure 7:
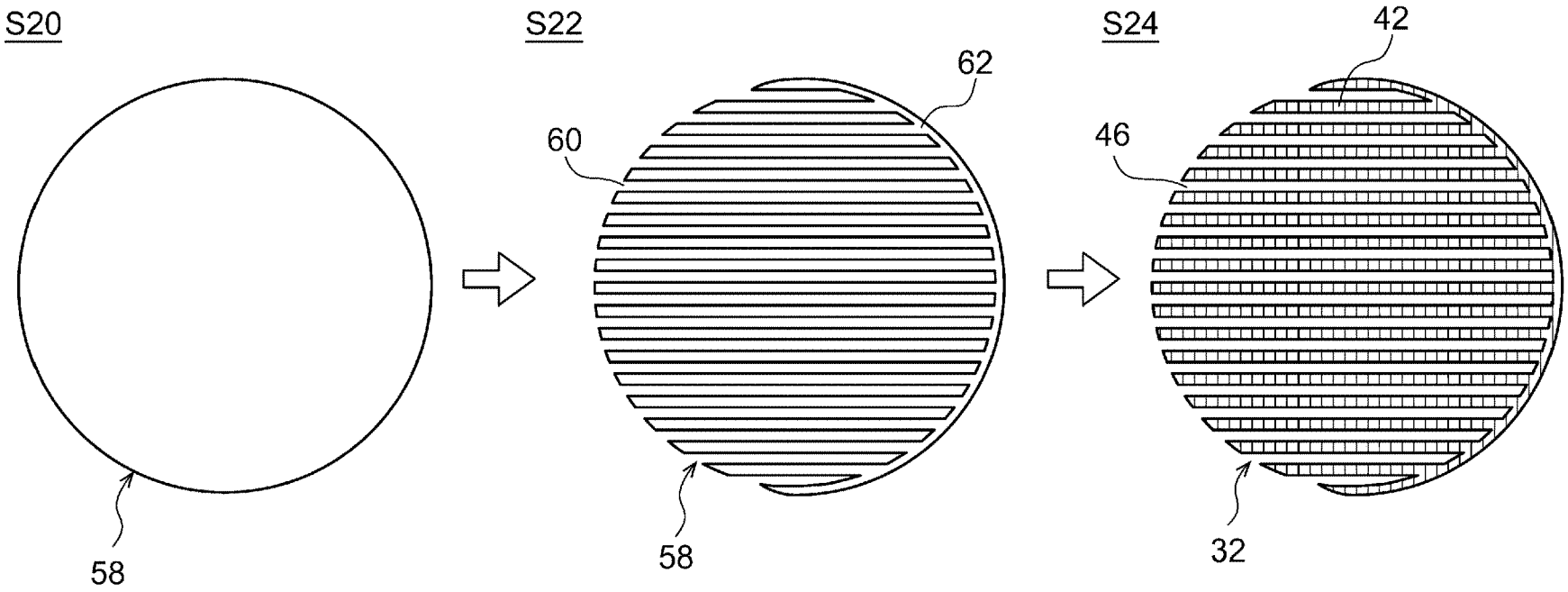
FIG. 7 is a schematic view illustrating another example of the method for manufacturing an integral flow straightener according to the embodiment.

FIG. 7 is a schematic view illustrating another example of the method of manufacturing the integral flow straightener 32 according to the embodiment. The integral flow straightener 32 according to the embodiment can be manufactured by other methods. FIG. 7 illustrates a method of manufacturing the integral flow straightener 32 using wire cutting. First, a base material 58 is prepared (S20). The base material 58 has, for example, a disc shape and is formed of a high thermal conductive metal material such as copper (for example, pure copper).

Next, first wire cutting is performed (S22). Accordingly, a large number of grooves 60 are formed. In order not to separate the base material 58 into a large number of elongated pieces, in the wire cutting, cutting is started from one side (left side in FIG. 7) of the base material 58, and the cutting is performed such that the outer periphery of the base material 58 is slightly left on the opposite side (right side in the FIG. 7) (for example, a semicircular outer peripheral frame 62 is left).

Subsequently, second wire cutting is performed (S24). The second wire cutting is performed from a direction orthogonal to the first wire cutting (for example, a direction perpendicular to the paper surface), and a large number of protrusions 42 are formed. The second wire cutting is also performed so as not to separate the base material 58 into a large number of small pieces, similar to the first wire cutting. The grooves 60 formed by the first wire cutting becomes the heat exchange slits 46. In this way, the integral flow straightener 32 may be manufactured.

In addition, the integral flow straightener 32 illustrated in FIG. 7 may be manufactured by the 3D printing. In this case, since the outer peripheral frame 62 can be formed on the entire circumference, this is advantageous in enhancing the strength of the integral flow straightener 32.

the present invention has been described above on the basis of the embodiment. It should be understood by those skilled in the art that the present invention is not limited to the above embodiment, that various design changes are possible and various modification examples are possible, and that such modification examples are also within the scope of the present invention. Various features described in relation to a certain embodiment can also be applied to other embodiments. New embodiments created by combination have the effects of respective combined embodiments in combination.

In the above-described embodiment, the integral flow straighteners 32 are provided at both ends of the first-stage pulse tube 18 and both ends of the second-stage pulse tube 24. However, in a certain embodiment, the integral flow straightener 32 may be provided at any one (for example, only the first-stage pulse tube low-temperature end 18*b*) of the first-stage pulse tube high-temperature end 18*a* or the first-stage pulse tube low-temperature end 18*b*. The integral flow straightener 32 may be provided at any one (for example, only the second-stage pulse tube low-temperature end 24*b*) of the second-stage pulse tube high-temperature end 24*a* or the second-stage pulse tube low-temperature end 24*b*.

In the present invention, it is not essential that the pulse tube cryocooler 10 is a four-valve type pulse tube cryocooler. The pulse tube cryocooler 10 may have phase control mechanisms of different configurations, for example, may be a double inlet type pulse tube cryocooler or an active buffer type pulse tube cryocooler. Additionally, in the above-described embodiment, the case where the integral flow straightener 32 is applied to the GM type pulse tube cryocooler 10 has been described as an example. However, the present invention is not limited to this, and the integral flow straightener 32 according to the embodiment may be applied to a Sterling pulse tube cryocooler or other pulse tube cryocoolers. Although the above-described embodiment has been described by taking the two-stage pulse tube cryocooler 10 as an example, the pulse tube cryocooler 10 may be a single-stage type or a multi-stage type (for example, a three-stage type).

In the above-described embodiment, some examples in which the flow straightening layer 32*a* has the plurality of protrusions 42 have been described. However, the integral flow straightener 32 may have other configurations. As exemplified with reference to FIGS. 5A and 5B, the flow straightening layer 32*a* may have a large number of through-holes 56 instead of protrusions.

Thus, in certain embodiments, a pulse tube cryocooler includes a pulse tube that includes a tube inner space, and an integral flow straightener disposed at a low-temperature end and/or a high-temperature end of a pulse tube. the integral flow straightener includes a flow straightening layer disposed to face the tube inner space so as to straighten a refrigerant gas flow from the tube inner space or into the tube inner space and a heat exchange layer formed integrally with the flow straightening layer outside the flow straightening layer with respect to the tube inner space so as to exchange heat with the refrigerant gas flow by contact with the refrigerant gas flow, The flow straightening layer may include a plurality of through-holes penetrating from an upper surface to a lower surface of the flow straightening layer, and the tube inner space may communicate with the heat exchange layer through the plurality of through-holes.

The heat exchange layer may include a plurality of heat exchange walls that extend parallel to a first in-plane direction of the heat exchange layer and are disposed alternately with a plurality of heat exchange slits in a second in-plane direction of the heat exchange layer orthogonal to the first in-plane direction of the heat exchange layer so as to define the plurality of heat exchange slits that penetrate the heat exchange layer in an extending direction of the pulse tube and extend parallel to the first in-plane direction of the heat exchange layer orthogonal to the extending direction of the pulse tube. A plurality of through-holes may be lined up along at least one heat exchange slit. The plurality of through-holes may be lined up along each of the plurality of heat exchange slits. The tube inner space may communicate with the heat exchange slit through the plurality of through-holes.

The plurality of through-holes may extend parallel to the extending direction of the pulse tube from the tube inner space to the heat exchange layer (for example, the heat exchange slit). The length of the plurality of through-holes in the extending direction of the pulse tube may be larger than the thickness of the heat exchange layer in the extending direction of the pulse tube. The length of the through-holes maybe, for example, larger than twice, larger than 5 times, or larger than 10 times the thickness of the heat exchange layer. The length of the through-holes may be set so as not to exceed an upper surface of a cooling stage when the integral flow straightener is mounted on the cooling stage.

The plurality of through-holes may be lined up in the first in-plane direction in at least two rows along one heat exchange slit.

The present invention is available in the field of a pulse tube cryocooler and a method for manufacturing a pulse tube cryocooler.

It should be understood that the present invention is not limited to the above-described embodiment, but may be modified into various forms on the basis of the spirit of the present invention. Additionally, the modifications are included in the scope of the present invention.

What is claimed is:

1. A pulse tube cryocooler comprising:

a pulse tube that includes a tube inner space; and an integral flow straightener disposed at at least one of a low-temperature end and a high-temperature end of the pulse tube and comprising:

a flow straightening layer disposed to face the tube inner space so as to straighten a refrigerant gas flow from the tube inner space or into the tube inner space, and a heat exchange layer formed integrally with the flow straightening layer outside the flow straightening layer with respect to the tube inner space so as to exchange heat with the refrigerant gas flow by contact with the refrigerant gas flow, wherein the flow straightening layer includes a plurality of protrusions that protrude from the heat exchange layer toward the tube inner space, wherein the heat exchange layer comprises:

a plurality of heat exchange walls that extends parallel to a first in-plane direction of the heat exchange layer, wherein the plurality of heat exchange walls is disposed alternately with a plurality of heat exchange slits in a second in-plane direction of the heat exchange layer, wherein the second in-plane direction of the heat exchange layer is orthogonal to the first in-plane direction of the heat exchange layer;

wherein the plurality of heat exchange slits penetrates the heat exchange layer in an extending direction of the pulse tube;

wherein the plurality of heat exchanges slits extends parallel to the first in-plane direction of the heat exchange layer, the first in-plane direction of the heat exchange layer being orthogonal to the extending direction of the pulse tube, and wherein the plurality of protrusions protrude from each of the plurality of heat exchange walls toward the tube inner space and are lined up in the first in-plane direction on each heat exchange wall.

2. The pulse tube cryocooler according to claim 1, wherein the plurality of protrusions stand upright from the heat exchange layer toward the tube inner space in parallel with an extending direction of the pulse tube.

3. The pulse tube cryocooler according to claim 1, wherein the plurality of protrusions are arranged in a grid pattern.

4. The pulse tube cryocooler according to claim 1, wherein a length of the plurality of protrusions in an extending direction of the pulse tube is larger than a thickness of the heat exchange layer in the extending direction of the pulse tube.

5. The pulse tube cryocooler according to claim 4, wherein the length of the plurality of protrusions in the extending direction of the pulse tube is larger than 10 times the thickness of the heat exchange layer in the extending direction of the pulse tube.

6. The pulse tube cryocooler according to claim 1, wherein at least one of the plurality of protrusions branches off.

7. The pulse tube cryocooler according to claim 1, wherein the plurality of protrusions are lined up in the first in-plane direction in at least two rows on each heat exchange wall.

8. The pulse tube cryocooler according to claim 1, wherein the integral flow straightener is disposed only at the low-temperature end of the pulse tube.

* * * * *